US006772775B2

(12) United States Patent
Ackerman et al.

(10) Patent No.: US 6,772,775 B2
(45) Date of Patent: Aug. 10, 2004

(54) SOOTBLOWER MECHANISM PROVIDING VARYING LANCE ROTATIONAL SPEED

(75) Inventors: Dean C. Ackerman, Junction City, OH (US); Clinton A. Brown, Baltimore, OH (US); James H. Hipple, Lancaster, OH (US); Kamal E. Kassouf, Lancaster, OH (US); Don W. Smith, Lancaster, OH (US)

(73) Assignee: Diamond Power International, Inc., Lancaster, OH (US)

( * ) Notice: Subject to any disclaimer, the term of this patent is extended or adjusted under 35 U.S.C. 154(b) by 192 days.

(21) Appl. No.: 10/029,900

(22) Filed: Dec. 20, 2001

(65) Prior Publication Data

US 2002/0078982 A1 Jun. 27, 2002

Related U.S. Application Data

(60) Provisional application No. 60/258,074, filed on Dec. 22, 2000.

(51) Int. Cl.[7] ..... B08B 3/02

(52) U.S. Cl. ..... 134/167 C; 134/169 C; 134/181; 122/390; 239/263.3

(58) Field of Search ..... 122/379, 390, 122/391, 392; 239/263.3; 134/166 R, 167 R, 168 R, 169 R, 172, 180, 181

(56) References Cited

U.S. PATENT DOCUMENTS

| | | | | |
|---|---|---|---|---|
| 1,682,278 A | * | 8/1928 | Heaton | 15/318 |
| 2,883,694 A | | 4/1959 | Hibner, Jr. et al. | |
| 3,127,109 A | * | 3/1964 | Frase | 239/162 |
| 3,230,568 A | | 1/1966 | Saltz | |
| 3,344,459 A | | 10/1967 | Jankowski | |
| 3,593,691 A | | 7/1971 | Eckenhagen et al. | |
| 3,613,703 A | * | 10/1971 | Stout | |
| 3,701,341 A | | 10/1972 | Willis, Jr. | |
| 3,823,927 A | * | 7/1974 | Budzinski | |
| 3,902,670 A | * | 9/1975 | Koller et al. | 239/227 |
| 4,106,760 A | * | 8/1978 | Kono et al. | 266/281 |
| 4,380,843 A | | 4/1983 | Sullivan et al. | |
| 4,387,481 A | | 6/1983 | Zalewski | |
| 4,399,773 A | | 8/1983 | Schwade et al. | |
| 4,437,201 A | | 3/1984 | Zalewski | |
| 4,492,187 A | | 1/1985 | Hammond | |
| 4,527,515 A | | 7/1985 | Hester, II | |
| RE32,517 E | | 10/1987 | Nelson | |
| 4,718,376 A | | 1/1988 | Leroueil et al. | |
| 4,803,959 A | | 2/1989 | Sherrick et al. | |
| 4,877,185 A | * | 10/1989 | Kufrin | |
| 4,905,900 A | | 3/1990 | Scharton et al. | |
| 4,989,785 A | * | 2/1991 | Walendowski | |
| 5,063,632 A | | 11/1991 | Clark et al. | |
| 5,083,539 A | * | 1/1992 | Cornelio | |
| 5,181,482 A | | 1/1993 | Labbe et al. | |
| 5,320,073 A | | 6/1994 | Silcott et al. | |

FOREIGN PATENT DOCUMENTS

| | | |
|---|---|---|
| JP | 2-284682 | * 11/1990 |

* cited by examiner

*Primary Examiner*—Frankie L. Stinson
(74) *Attorney, Agent, or Firm*—Brinks Hofer Gilson & Lione

(57) ABSTRACT

A drive assembly for a sootblower which provides a non-constant rate of rotational motors of the lance tube through the use of non-circular gears in the drive assembly. The drive assembly is used to provide a uniform or near uniform rate of progression of a jet of cleaning medium ejected from the lance tube along a surface to be cleaned.

16 Claims, 5 Drawing Sheets

SOOTBLOWER MECHANISM PROVIDING VARYING LANCE ROTATIONAL SPEED

CROSS-REFERENCE TO RELATED APPLICATIONS

The present invention claims priority to U.S. Provisional Patent Application Serial No. 60/258,074, filed on Dec. 22, 2000, entitled "Sootblower Mechanism Providing Varying Lance Rotational Speed.

BACKGROUND

This invention relates generally to a sootblower device for directing a fluid spray against heat exchanger surfaces in large-scale combustion devices, and particularly, to such a device for providing improvements in the uniformity of the cleaning effect provided.

Devices generally known as sootblowers have commonly performed cleaning surfaces within boilers, furnaces, or other devices in which a fossil fuel is combusted. Sootblowers typically employ water, steam, air, or a combination thereof, as a blowing medium, which is directed through one or more nozzles against encrustations of slag, ash, scale and/or other fouling materials, which become deposited on the surfaces.

Typical sootblowers of the long retracting type have a retractable lance tube which is periodically advanced into and withdrawn from the boiler and is simultaneously rotated such that one or more blowing medium nozzles at the end of the lance tube project blowing medium jets tracing helical paths.

Operators of large-scale boilers are continuously striving to improve the efficiency of their operation. The blowing medium discharge by sootblowers constitutes a thermal efficiency penalty for the overall operation of the boiler system. In addition, sootblowers further require substantial quantities of superheated steam or other pressurized fluid in order to effectively operate. Therefore, there is a desire to minimize the frequency of operation of sootblowers and the quantity of fluid which they discharge during each cleaning cycle.

Most efficient sootblower cleaning operation occurs when the jet of fluid emitted from the nozzle advances along the heat exchanger surfaces at a nearly uniform progression rate. Achieving such uniformity is difficult in situations where the distance between the sootblower nozzle and the surface being cleaned changes during the rotational motion of the lance tube. For example, if the lance tube is rotated as it is extended and retracted from the boiler and the surfaces being cleaned are planar surfaces such as pendant wall sections of water tubes, operating the lance tube at a constant rotational speed produces significant variations in the progression rate of the impact area of the cleaning medium stream advancing along a path on the surfaces. Thus, where the rate of jet progression is lowest, excessive quantities of sootblowing medium are used as compared with the amount required for effective cleaning. Moreover, physical deterioration of the heat exchanger surfaces may also occur where they are "over cleaned" in this manner. However, the cleaning requirements in areas where the jet progression rate is greatest may compel the operator to select rotation and translation speeds based on such "worst case" conditions, which further exacerbates the previously noted problems in the areas where jet progression is lowest.

Conventional sootblowers of the long retracting type use an elongated frame having a carriage assembly which is driven for movement along the frame. The lance tube is carried by the carriage. An internal drive mechanism causes a drive pinion gear to rotate which meshes with an elongated toothed rack fixed to the frame, driving the carriage for longitudinal motion. Through another set of gears, the lance tube is caused to rotate as the carriage and lance move longitudinally.

In order to overcome the previously noted disadvantages inherent in sootblower lance tubes operating at constant rotational speeds, designers of such systems have employed various solutions. One solution involves a complex drive system for the sootblower utilizing variable speed motor controllers coupled with position sensors which detect lance tube longitudinal and rotational position. Examples of such mechanisms are described in U.S. Pat. Nos. 5,337,438, 5,437,295, and Re. 32,517, which are commonly owned by the Assignee of this application and are hereby incorporated by reference. Although highly effective, the systems described by the previously referenced patents tend to impose a significant cost penalty due to the requirements of employing the previously noted controller and drive system elements. Thus, such prior art systems have cost disadvantages which may preclude their application where their capabilities may be effectively utilized. In addition to the previously noted shortcomings, such sophisticated sootblower systems pose maintenance challenges in the hostile environment in which they are employed.

One type of sootblower drive mechanism provides oscillating rotational motion. That is, the lance tube reversibly rotates through an arc and does not complete full rotations. Examples of such oscillating type sootblower systems are provided with reference to U.S. Pat. Nos. 4,177,539 and 4,351,082, both of which are commonly assigned with application and are hereby incorporated by reference. The Elting U.S. Pat. No. 4,177,539 disclose an oscillating mechanism using a so-called Scotch Yoke mechanism. This system produces an oscillating rotational motion for the lance tube, which could provide a varying angular speed. However, the mechanism required according to the Etling patent does not provide an adequate angular speed variation to prove constant jet progression and is a complex mechanism requiring specialized components and modifications to existing sootblower carriage systems.

Accordingly, there is a need in the art to provide a sootblower system which provides a more constant rate of jet progression without the disadvantages of sophisticated control systems as noted previously.

SUMMARY OF THE INVENTION

In accordance with the present invention, a lance tube drive system is disclosed which provides variable rotational speed, purely through the use of mechanical drive elements. In the described embodiment, a gear reduction unit driven through a power takeoff point of the carriage assembly is coupled through a meshing set of non-circular gears to provide a variable rotational speed output. This output is used to drive the lance tube for rotational motion. By establishing an indexed relative position between the lance tube nozzles and the non-circular gears, a desired variation in angular speed can be provided. Since it is purely mechanical, the system has inherent cost and reliability advantages over systems requiring sophisticated control components.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
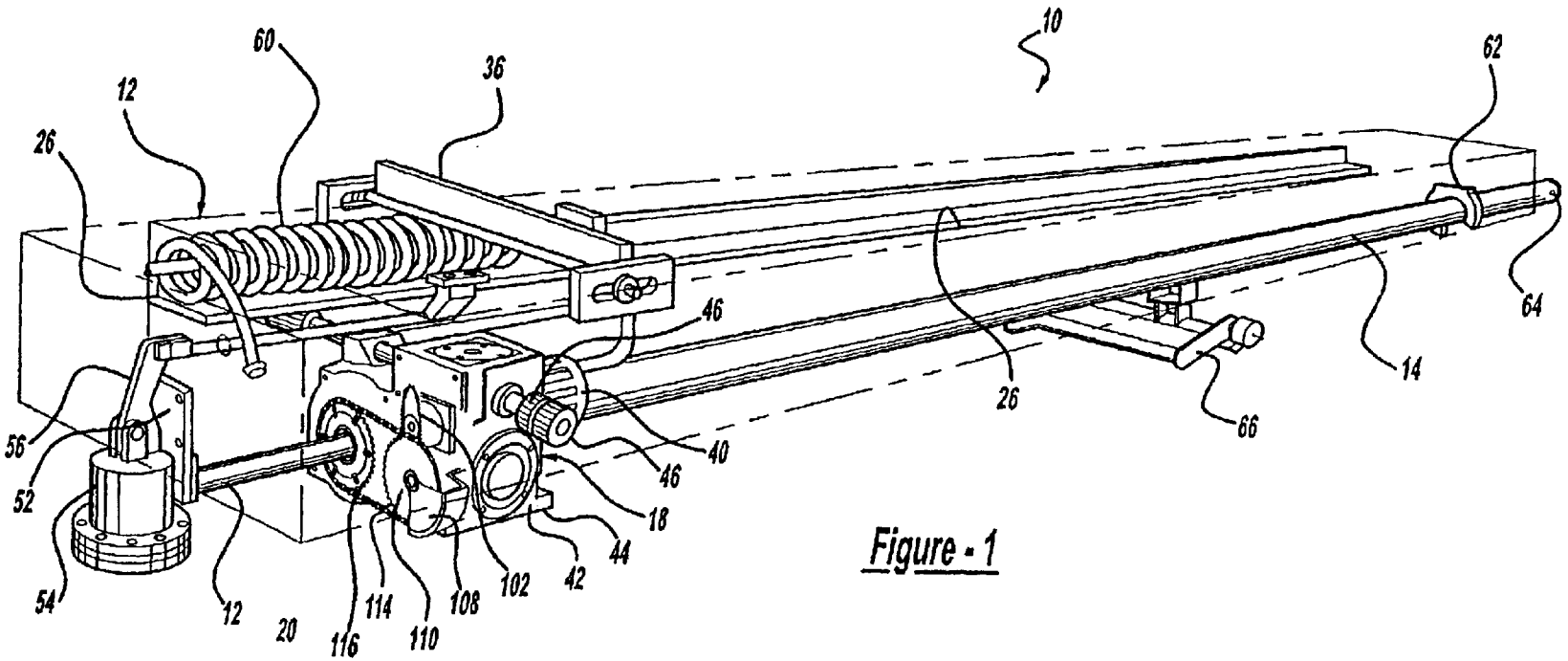
FIG. 1 is a pictorial view showing a long retracting sootblower incorporating the features of a preferred embodiment of the present invention.

The sootblower assembly including the improvements of the present invention is shown in FIG. 1 and is generally designated there by reference number 10. Sootblower assembly 10 principally comprises frame assembly 12, lance tube 14, feed tube 16, and carriage assembly 18. Sootblower 10 is shown in its normal resting non-operating position. Upon actuation, lance tube 14 is extended into and retracted from a boiler (not shown) and is simultaneous rotated.

As best shown in FIG. 1, frame assembly 12 includes a generally rectangular shaped frame box 20 which forms a housing for the entire unit. Carriage assembly 18 is guided along a pair of tracks 22 shown in FIG. 4 located on opposite sides of frame box 20. Tracks 22 are connected to frame box 20 by threaded fasteners or welding. Toothed racks 24 are connected to a pair of upper tracks 26 and are provided to enable longitude movement of carriage 18. Frame assembly 12 is supported at a wall box (not shown) which is affixed to the boiler wall or another mounting structure, and is further supported by a rear support bracket 36.

Carriage assembly 18 drives lance tube 14 into and out of the boiler and includes drive motor 40 and gear-box 42, which is enclosed by housing 44. Carriage assembly 18 drives a pair of pinion gears 46, which engage the toothed racks 24 to advance carriage assembly 18 and lance tube 14 along frame assembly 12. Lance tube 14 is mounted to lance tube hub 50 which also controls the rotational position of the lance tube.

Feed tube 16 is attached at one end to rear bracket 52 and conducts blowing medium such as steam or air, which is controlled through the action of poppet valve 54. Poppet valve 54 is actuated through linkages 56 which are engaged by carriage assembly 18 to begin blowing medium discharge upon extension of lance tube 14, and cuts off the flow once carriage assembly 18 returns to the normal retracted position shown in FIG. 1. Lance tube 14 over-fits feed tube 16 and a fluid seal between them is provided by packing gland 48 so that blowing medium conducted into lance tube 14 from feed tube 16 is discharged from one or more nozzles 64 at the distal end of the lance tube.

Coiled electrical cable 60 conducts power for drive motor 40 as carriage assembly 18 moves along frame assembly 12. Front support bracket 62 includes bearings which support lance tube 14 during its longitudinal and rotational movement. For long lance tube lengths, an intermediate support 66 may be provided to prevent excessive bending deflection of the lance tube. Additional details of the construction of the well known design "IK" series sootblower manufactured by the Assignee is found in U.S. Pat. No. 3,439,376, which is hereby incorporated by reference.

The conventional sootblower carriage assembly 18 as described in the previously noted patent includes an internal gear drive system in which drive motor 40 drives the carriage to move longitudinally through rotation of pinion gears 46. Simultaneous with the longitudinal motion of carriage assembly 18, another gear set drives lance hub 50 causing the lance tube 14 to rotate simultaneous with its longitudinal motion. For these types of sootblowers, the lance tube 14 undergoes full rotations during the longitudinal movement, usually at a constant angular speed. Accordingly, spray from nozzles 64 trace helical patterns as lance tube 14 advances into and is withdrawn from the boiler for cleaning. However, the carriage assembly 18, in accordance with this invention, does not use a conventional rotational drive mechanism within carriage assembly 18 which cause rotation of the lance tube 14. Instead, that function is performed by novel elements in accordance with this invention as described hereinafter.

Carriage assembly 18 of the conventional type manufactured by the assignee includes a shaft end 86 having a square cross-sectional end configuration, which extends from the rear face of the carriage assembly. This shaft is one of the internal shafts of carriage assembly 18, and by rotating it using a manual or power driven tool, the carriage assembly can be moved, even while electrical power is not available or up on failure of drive motor 40 or other switching and control components. However, in accordance with a preferred embodiment of this invention, square drive tang 86, as shown in FIG. 2, is provided as a power take-off point used to drive externally applied elements which actuate the lance tube for varying rotational speed motion.

Figure 2:
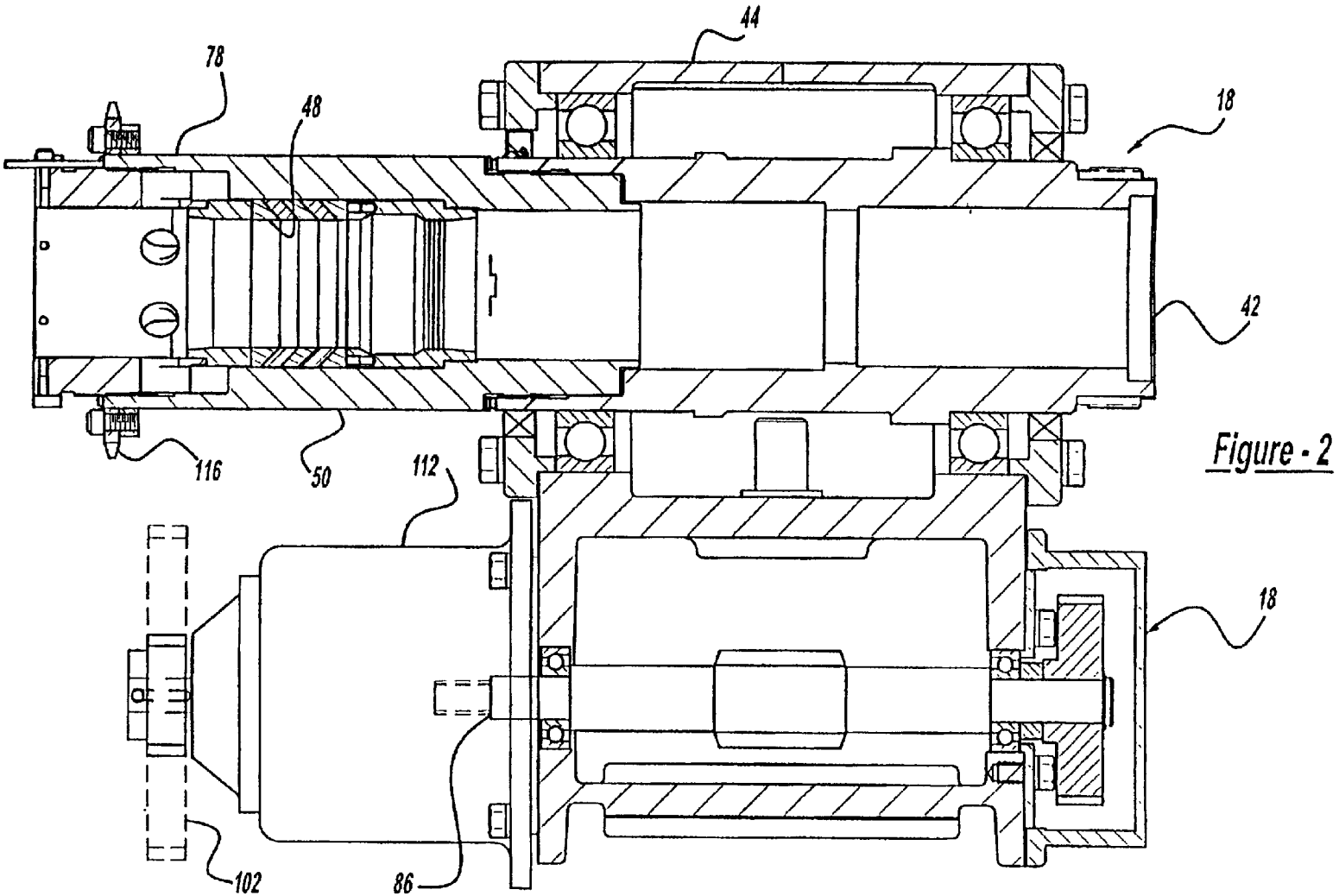
FIG. 2 is a horizontal cross-sectional view of the carriage assembly shown in FIG. 1.
Figure 3:
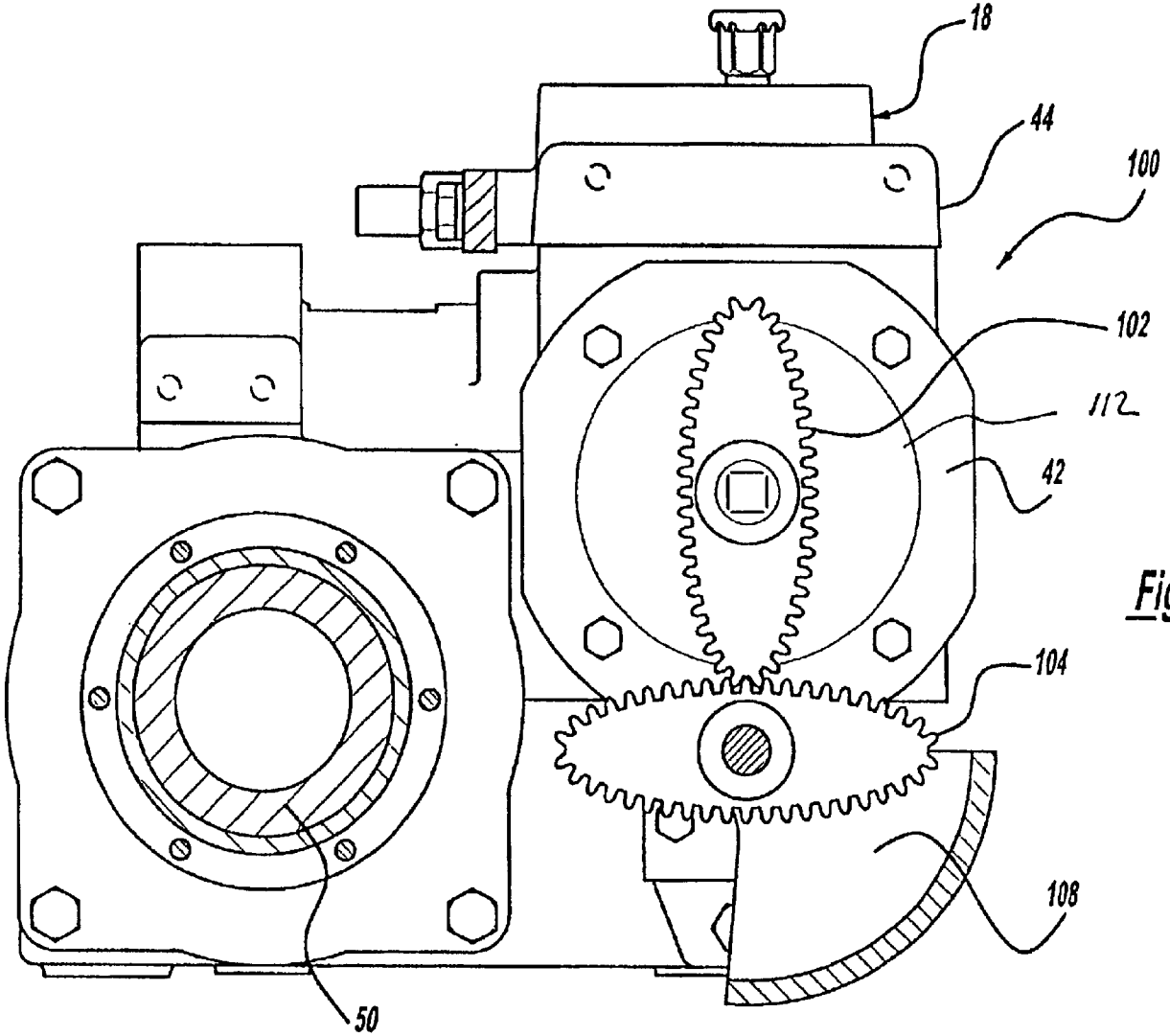
FIG. 3 is a sectional front view of the carriage assembly showing non-circular gear set assembly of this invention.
Figure 4:
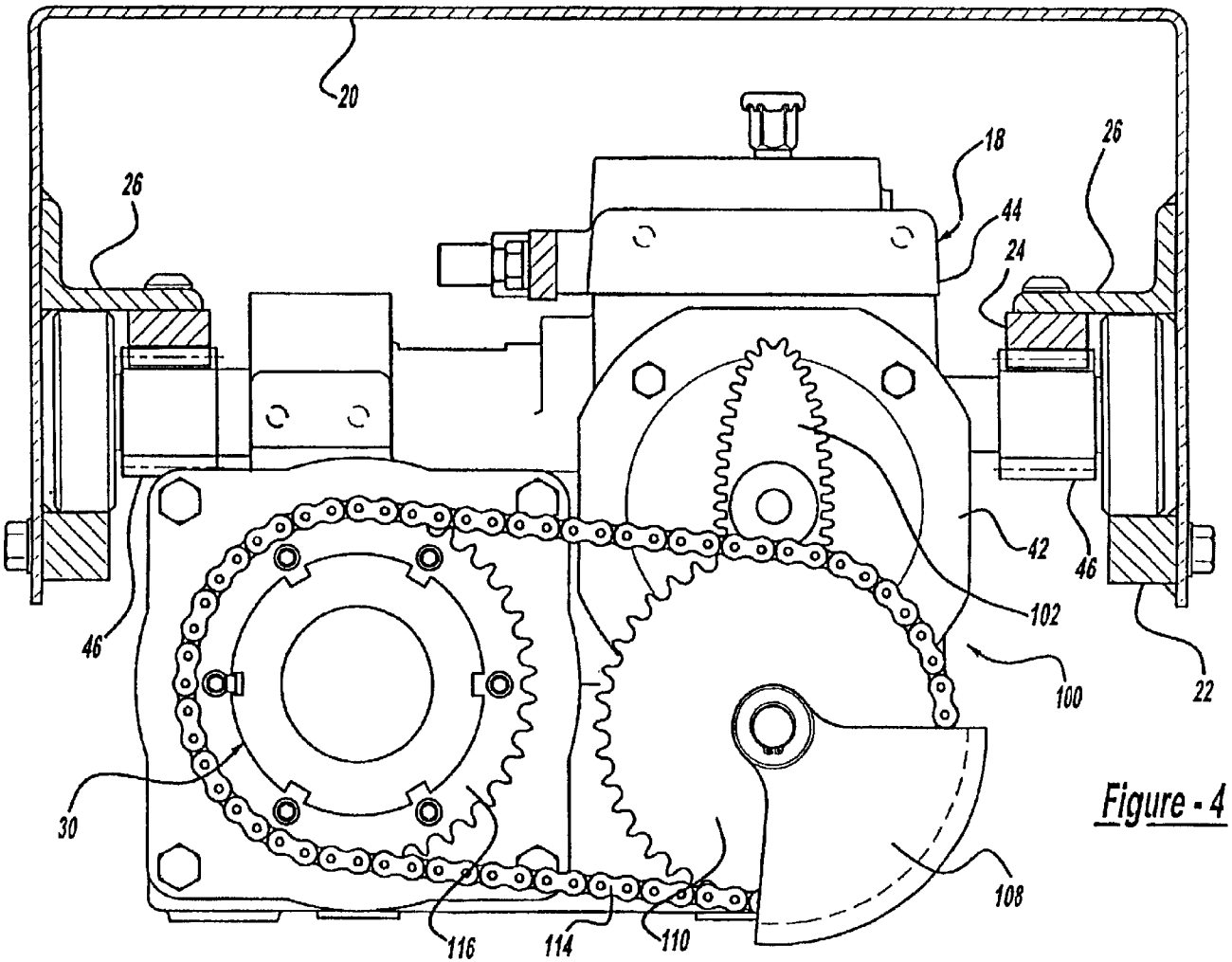
FIG. 4 is a rear view of the carriage assembly showing the noncircular gear set assembly.

Now with reference to FIGS. 2, 3 and 4, a gear set assembly 100 is shown utilizing non-circular meshing gears. As shown, the non-circular gear set assembly 100 includes stand-off drive extension 112 which is piloted onto square drive tang 86 for rotational movement and provides a mount for positioning gear 102 at a proper location. Standoff drive extension 112 attaches and rotates non-circular gear 102. A cup shaped chain guard 108 protects gear 110 as shown in FIGS. 3 and 4. Non-circular gear 104 meshes with and is driven by gear 102 and is carried by a shaft and fixed to and rotates with gear 110. As best shown in FIG. 4, chain 114 meshes with gear 110 and gear 116 which rotates lance hub 50.

Non-circular gears 102 and 104 each have a roughly ellipsoid shape and feature a variation in their pitch radius, from their minimum to their maximum, of about 1 to 5. When two such gears are in meshing engagement, it follows that a final drive ratio variation of 1 to 5 (1:5), to 5 to 1 (5:1) occurs (thus the relationship between in highest and lowest ratio is a multiple of 25). Thus a constant input rotational speed of gear 102 produces a variable speed output from gear 104 of a roughly sinusoidal characteristic. The types of meshing gears as illustrated would provide two points of maximum and minimum speeds per revolution.

Although not illustrated in the Figures, the non-circular gear set assembly 100 could be integrated internally within carriage assembly 18. In a further variation, gears 102 and 104 could have other shapes, such as a shape similar to that of a single lobe cam, which would provide a single maximum and a single minimum angular speed position per revolution.

Figure 5:
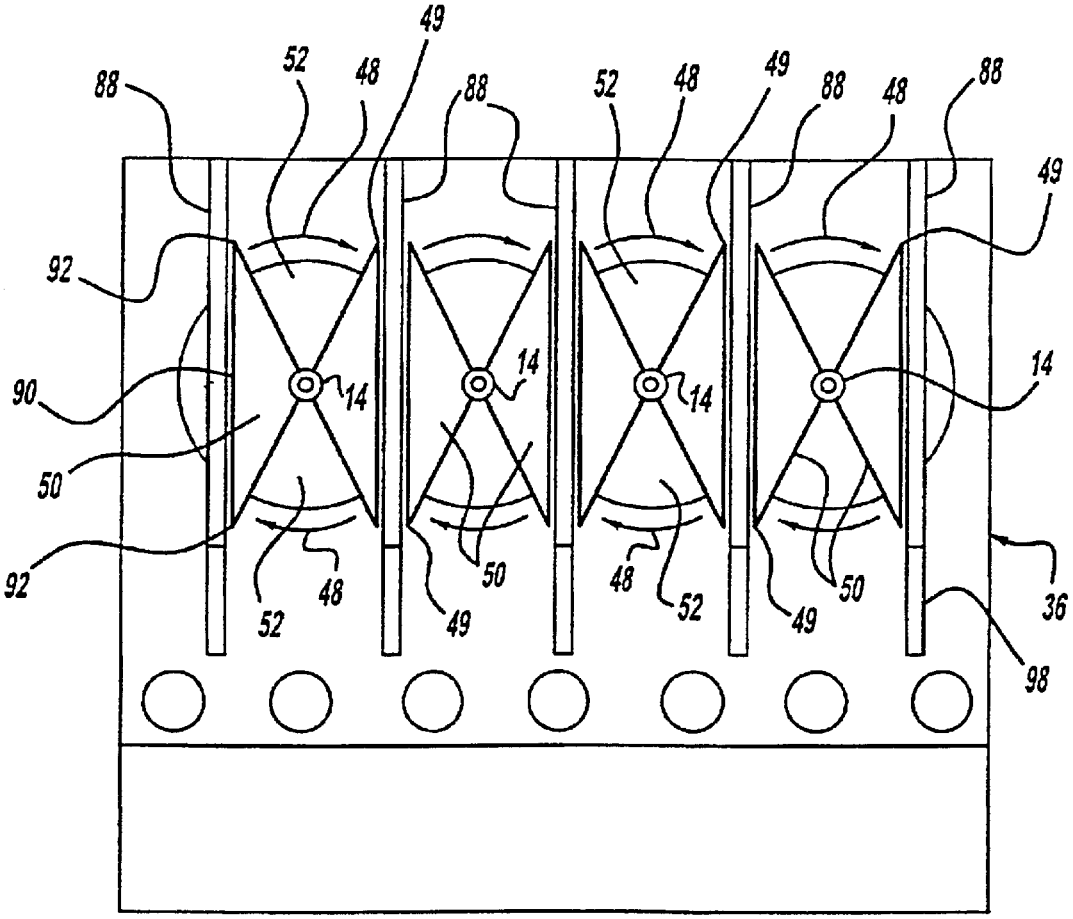
FIG. 5 is a view taken from the inside of a large scale combustion boiler showing an outside wall surface with a plurality of sootblower lance tubes for cleaning pendant wall sections.

Now with reference to FIG. 5, an interior of a boiler having a plurality of sootblowers 10 is shown. This Figure shows lance tubes 14 projecting out of the drawing sheet. Pendant wall sections 88 hang from the upper portion of the boiler. Nozzles 64 are shown directing spray along the lines shown.

As shown in FIG. 5, at the point of initial impingement of the blowing medium jet, designated by reference number 90, the nozzle jet is projected horizontally and the distance from the nozzle 64 to the pendant 88 is at its minimum value. Thereafter, upon continued angular displacement of lance tube 14, this distance increases as the jet continues to progress up (or down) the wing wall 98 to point 92, representing the farthest point up or down wall 88 where effective cleaning can be provided. The position of point 92 is affected by a degradation in cleaning effect caused by a loss in energy of the jet over a long spray distance, expansion of the spray over its length, and the grazing incidence angle. For a constant rate of rotation of lance tube 14, the rate of progression of the point of impingement of the jet along the surface of the wall 88 will be much slower at points 90 which are substantially horizontal from lance tube 14 (i.e., closer to the lance tube) and much faster in those areas near the final impingement areas 92 (i.e., farther from the lance tube) resulting in uneven cleaning. However, the non-circular gear set assembly 100 provides a non-linear rate of rotational movement which is selected to provide more uniform jet progression.

In order to provide the desired speed variation, it is necessary to properly phase gear set assembly 100 with the angular position of nozzles 64. Since it is desirable to rotate fastest at point 90 representing the minimum distance between nozzle 64 and wall 88, gear 102 engages gear 104 at its maximum pitch radius point as shown in FIG. 3. When nozzles 64 are directed vertically upwardly or downwardly, gear 102 is engaged with gear at its minimum pitch radius point. Accordingly, the angular speed of the lance decreases from its maximum value when the nozzles are pointed horizontally decreasing as the jets are oriented toward the vertical directions.

The precise jet progression rate along the surfaces to be cleaned by sootblower 10 is affected by numerous factors, including: the configuration of the surface to be cleaned, the distance of the lance to the surface, and the drive train characteristics including the shape of gears 102 and 104. Implementation of the present invention may not provide, for specific applications, a truly uniform jet progression velocity. However, advantages of the present invention are largely realized when the rotational rate of the lance is modified from constant speed to a variable speed as provided by this invention.

It is to be understood that the invention is not limited to the exact construction illustrated and described above, but that various changes and modifications may be made without departing from the spirit and scope of the invention as defined in the following claims.

We claim:

1. A drive assembly for a sootblower that includes a carriage and a lance tube affixed to said carriage having one or more nozzles for directing a jet of fluid cleaning medium against surfaces to be cleaned, comprising:

a drive motor providing a rotary shaft output;

a lance rotational drive train having two or more non-circular gears in meshing engagement having a drive train input coupled to said drive motor rotary shaft output and having a drive train output wherein said non-circular gears provide a variable drive ratio such that the relationship between the angular speed of said drive train input to the angular speed of said drive train output varies with the rotational position of said non-circular gears; and a lance tube drive coupling said drive train output to said lance tube for causing rotation of said lance tube whereby said lance tube is driven for rotation at a non-constant speed.

2. A drive assembly according to claim 1 wherein said drive motor provides a substantially constant rotational speed output of said rotary output.

3. A drive assembly according to claim 1 wherein said lance rotational drive train is phased with respect to said surfaces to be cleaned such that the rate of rotational motion of said lance tube is at a maximum value where the length of said jet measured between said nozzle and said surface to be cleaned is at its minimum and the rate of rotation is lower than said maximum value where the length of said jet is greater than said minimum value.

4. A drive assembly according to claim 1 wherein said non-circular gears have a generally ellipsoid shape.

5. A drive assembly according to claim 1 wherein said non-circular gears each have a variation in their pitch diameter of about 5 to 1.

6. A drive assembly according to claim 1 wherein said non-circular gears mesh to provide two points each of a maximum drive ratio and a minimum drive ratio per revolution each one of said gears.

7. A drive assembly according to claim 6 wherein said lance has a pair of nozzles oriented to discharge said fluid cleaning medium at an angle of about 90 degrees from the longitudinal axis of said lance and wherein said nozzles are diametrically opposed to discharge in opposite directions.

8. A drive assembly according to claim 1 wherein said lance rotational drive is coupled to said lance by a drive chain.

9. A drive assembly according to claim 1 wherein said sootblower is a retracting type further having a frame assembly and said carriage moving along said frame assembly to extend and retract said lance tube.

10. A drive assembly for a sootblower that includes a frame assembly, a carriage movable along said frame assembly, a lance tube affixed to said carriage having one or more nozzles for directing a jet of fluid cleaning medium against surfaces to be cleaned, comprising:

a drive motor providing a rotary shaft output;

a lance rotational drive train having two or more non-circular gears in meshing engagement having a drive train input coupled to said drive motor rotary shaft output and having a drive train output wherein said non-circular gears provide a variable drive ratio such that the relationship between the angular speed of said drive train input to the angular speed of said drive train output varies with the rotational position of said non-circular gears; and a lance tube drive coupling said drive train output to said lance tube for causing rotation of said lance tube at a non-constant rotational speed, said lance rotational drive train being phased with respect to said surfaces to be cleaned such that the rate of rotational motion of said lance tube is at a maximum value where the length of said jet measured between said nozzle and said surface to be cleaned is at its minimum and the rate of rotation is lower than said maximum value where the length of said jet is greater than said minimum value.

11. A drive assembly according to claim 10 wherein said drive motor provides a substantially constant rotational speed output of said rotary output.

12. A drive assembly according to claim 10 wherein said non-circular gears have a generally ellipsoid shape.

13. A drive assembly according to claim 10 wherein said non-circular gears each have a variation in their pitch diameter of about 5 to 1.

14. A drive assembly according to claim 10 wherein said non-circular gears mesh to provide two points each of a maximum drive ratio and a minimum drive ratio per revolution each one of said gears.

15. A drive assembly according to claim 14 wherein said lance has a pair of nozzles oriented to discharge said fluid cleaning medium at an angle of about 90 degrees from the longitudinal axis of said lance and wherein said nozzles are diametrically opposed to discharge in opposite directions.

16. A drive assembly according to claim 10 wherein said lance rotational drive is coupled to said lance by a drive chain.

* * * * *